US008381343B2

(12) United States Patent
Yun et al.

(10) Patent No.: US 8,381,343 B2
(45) Date of Patent: Feb. 26, 2013

(54) WASHING MACHINE AND CONTROL METHOD FOR DISENTANGLING CLOTHES IN THE WASHING MACHINE

(75) Inventors: Chang Sang Yun, Suwon-si (KR); Do Yeon Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 829 days.

(21) Appl. No.: 12/076,275

(22) Filed: Mar. 14, 2008

(65) Prior Publication Data

US 2008/0222818 A1 Sep. 18, 2008

(30) Foreign Application Priority Data

Mar. 16, 2007 (KR) ..... 10-2007-0026019

(51) Int. Cl.
*D06F 33/02* (2006.01)
*D06F 35/00* (2006.01)

(52) U.S. Cl. ..... 8/159

(58) Field of Classification Search ..... None
See application file for complete search history.

(56) References Cited

U.S. PATENT DOCUMENTS 6,158,072 A * 12/2000 Baek et al. ..... 8/159
6,401,284 B1 6/2002 Jeon et al.
7,596,824 B2 * 10/2009 Lee ..... 8/159
7,673,359 B2 * 3/2010 Lee ..... 8/158
2003/0056302 A1 3/2003 Broker et al.
2003/0217417 A1 11/2003 Jung
2004/0045097 A1 * 3/2004 Kim et al. ..... 8/159
2005/0016227 A1 * 1/2005 Lee ..... 68/12.04
2005/0268670 A1 * 12/2005 Hirasawa et al. ..... 68/12.06
2005/0283919 A1 * 12/2005 Kim ..... 8/158
2006/0005319 A1 * 1/2006 Park ..... 8/158
2006/0185095 A1 * 8/2006 Mitts ..... 8/158
2007/0186356 A1 * 8/2007 Kwon et al. ..... 8/158

FOREIGN PATENT DOCUMENTS

EP 1489217 * 12/2004
EP 1489217 A1 12/2004
WO WO 2004/025012 * 3/2004
WO WO2004/025012 A1 3/2004

OTHER PUBLICATIONS

European Search Report for corresponding European Patent Application No. 08151700.5 dated Sep. 30, 2009, 6 pgs (in English).

* cited by examiner

*Primary Examiner* — Joseph L Perrin
(74) *Attorney, Agent, or Firm* — Staas & Halsey LLP

(57) ABSTRACT

A washing machine and a method of controlling a laundry disentangling process are disclosed, which uses a laundry disentangle pattern capable of stepwise increasing the motor rpm simultaneously while adjusting the acceleration rate of the motor. The method of controlling the laundry disentangling process in the washing machine, which includes a rotation drum containing laundry and a motor rotating the rotation drum to disentangle tangled laundry, includes stepwise-increasing an rpm of the motor, and adjusting a stepwise-acceleration rate of the motor, and performing the laundry disentangling process.

10 Claims, 6 Drawing Sheets

WASHING MACHINE AND CONTROL METHOD FOR DISENTANGLING CLOTHES IN THE WASHING MACHINE

CROSS-REFERENCE TO RELATED APPLICATIONS

This application claims the benefit of Korean Patent Application No. 10-2007-0026019, filed on Mar. 16, 2007 in the Korean Intellectual Property Office, the disclosure of which is incorporated herein by reference.

BACKGROUND

1. Field

The present invention relates to a washing machine and a control method to disentangle clothes in the washing machine, and more particularly to a washing machine disentangling clothes entangled by a washing process to improve a performance of the washing machine, and a control method to disentangle clothes in the washing machine.

2. Description of the Related Art

Generally, a washing machine includes a water tub containing water (e.g., washing or rinsing water), a rotation drum rotatably installed into the water tub to contain laundry, and a motor generating a driving power to rotate the rotation drum. Therefore, the washing machine performs a washing process by allowing laundry contained in the rotation drum to move up and down along an inner surface of the rotation drum.

The washing machine sequentially performs a washing process, a rinsing process and a dehydration process. The washing process removes dust or pollution material from laundry using water (i.e., washing water) including a detergent. The rinsing process rinses the remaining detergent or bubbles out of the laundry using clean water (i.e., rinsing water). The dehydration process dehydrates the wet laundry at a high speed. Specifically, the washing process may entangle clothes constituting the laundry in the rotation drum because the clothes rotate close to an inner circumference of the rotating drum, so that the clothes constituting the laundry are not uniformly distributed in the drum, resulting in the occurrence of an unbalance caused by the eccentricity of the laundry.

If the dehydration process is performed when the laundry has been entangled in the drum, a delay of a dehydration time and a dehydration error may occur by the above-mentioned unbalance. In order to take out the laundry from the drum after completing the washing process, a user of the washing machine must exert a large force on the laundry, so that many users are not satisfied with the washing machine.

In order to solve the above-mentioned problems, a laundry disentangling process is additionally performed. In the laundry disentangling process, a rotation drum is alternately rotated for a short period of time before draining water in the washing process or the last rinsing process, so that the tangled clothes are smoothly disentangled.

The conventional laundry disentangling process rotates a motor at about 40~45 rpm in a forward direction for 5 seconds, then stops rotation of the motor for 5 seconds, rotates the motor in a reverse direction for 5 seconds, and then stops rotation of the motor for 5 seconds. In this way, the conventional laundry disentangling process alternately repeats the above-mentioned operations a predetermined number of times, so that the rotation drum is alternately rotated to disentangle the tangled laundry.

However, the above-mentioned laundry disentangling process commands the motor to be rotated at the same RPM and the same acceleration rate, so that the laundry cannot be sufficiently shaken, and is unbalanced to one side, resulting in the occurrence of serious unbalance.

In the case of another related washing machine equipped with a dryer, the laundry contained in the washing machine cannot smoothly move in the drum, so that the drying time becomes longer.

SUMMARY

Therefore, it is an aspect of the invention to provide a washing machine for evenly disentangling tangled laundry using a laundry disentangling pattern, which is capable of stepwise-increasing a motor rpm simultaneously while adjusting a motor acceleration rate, so that a performance of a washing machine is improved, and a method controlling the laundry disentangling process.

Additional aspects and/or advantages of the present invention will be set forth in part in the description which follows and, in part, will be apparent from the description, or may be learned by practice of the invention.

The foregoing and/or other aspects of the present invention can be achieved by providing a method of controlling a laundry disentangling process in a washing machine, which includes a rotation drum containing laundry and a motor rotating the rotation drum to disentangle tangled laundry, the method comprising: stepwise-increasing an rpm of the motor; and adjusting a stepwise-acceleration rate of the motor, and performing the laundry disentangling process.

The laundry disentangling process is performed in a washing or rinsing process. The laundry disentangling process is performed after the last dehydration process. The laundry disentangling process is performed before a drain process after the washing process, or is performed after an intermediate dehydration after the washing process. The laundry disentangling process is performed before a drain process after the rinsing process, or is performed after an intermediate dehydration after the rinsing process.

The stepwise-increasing of the motor rpm includes: rotating the motor in a forward or reverse direction with at least one rpm. The at least one rpm is a first or second rpm suitable for disentangling the laundry. The first rpm is at least 40 rpm. The first rpm is 40~65 rpm. The motor may also be rotated at a second rpm that is equal to or higher than the first rpm.

The adjusting of the stepwise-acceleration rate of the motor includes: stepwise adjusting the motor's acceleration rate to a first or second rpm. The adjusting of the stepwise-acceleration rate of the motor includes: rotating the motor in a forward or reverse direction at a first acceleration rate. The first acceleration rate is a first or second acceleration rate suitable to disentangle the laundry. The second acceleration rate is equal to or less than the first acceleration rate. The motor rotates at the first acceleration rate until reaching a first rpm, and rotates at a second acceleration rate until reaching a second rpm after exceeding the first rpm. The motor stops rotation during a predetermined time after rotating forward or backward.

The foregoing and/or other aspects of the present invention are also achieved by providing a washing machine comprising: a rotation drum which contains laundry; a motor which rotates the rotation drum; and a controller controlling a laundry disentangling process which stepwise increases an rpm of the motor, and adjusts a stepwise-acceleration rate of the motor to disentangle the tangled laundry.

The controller stepwise increases the motor rpm to a first or second rpm suitable to disentangle the tangled laundry, and rotates the motor in a forward or reverse direction at the first or second rpm. The second rpm is equal to or higher than the first rpm. The controller stepwise increases the motor rpm to a first or second acceleration rate suitable to disentangle the tangled laundry, and rotates the motor in a forward or reverse direction at the first or second acceleration rate. The controller rotates the motor at the first acceleration rate until the motor rpm reaches a first rpm, and rotates the motor at the second acceleration rate until the motor rpm reaches a second rpm after exceeding the first rpm.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
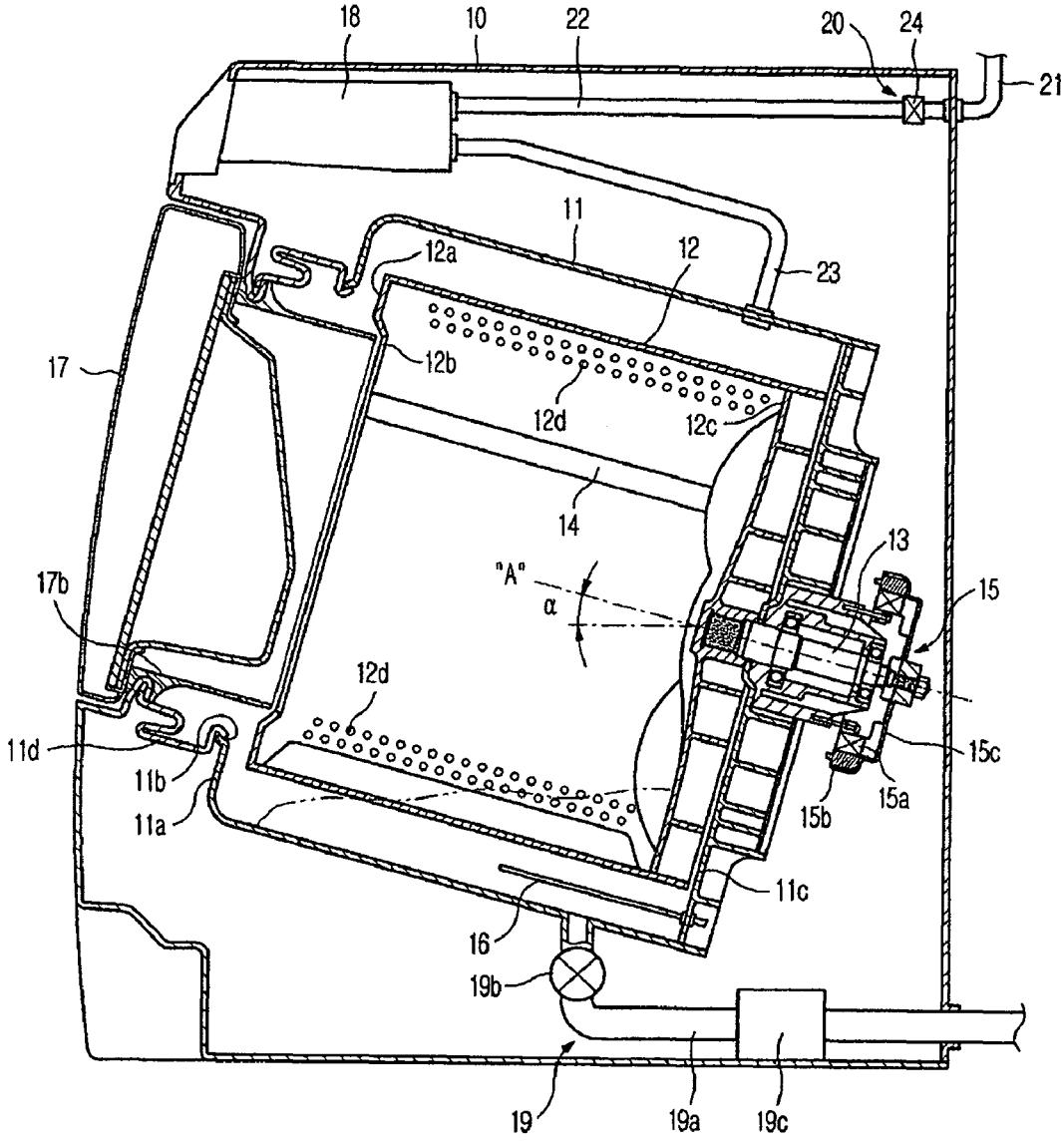
FIG. 1 is a cross-sectional view illustrating a washing machine according to an embodiment of the present invention.

Reference will now be made in detail to the embodiments of the present invention, examples of which are illustrated in the accompanying drawings, wherein like reference numerals refer to like elements throughout. The embodiments are described below to explain the present invention by referring to the figures.

FIG. 1 is a cross-sectional view illustrating a washing machine according to an embodiment of the present invention.

Referring to FIG. 1, the washing machine according to the embodiment of the present invention includes a drum-type water tub 11 installed in the housing 10 in order to contain the water therein, and a cylindrical rotation drum 12 rotatably installed in the water tub 11 in order to contain the laundry therein.

The water tub 11 is installed to have an inclination of a predetermined angle α on the basis of an installation surface of the washing machine, so that a front part 11*a* including an inlet 11*b* is arranged to be higher than the rear part 11*c*. The rotation drum 12 contained in the water tub 11 is installed to be tilted so that the front part 12*a* including the inlet 12*b* is located to be higher than the rear part 12*c*.

In other words, the front part 12*a* equipped with the inlet 12*b* in the rotation drum 12 is installed toward an upper forward direction, a center line of the drum's rotation A has an inclination of a predetermined angle α on the basis of an installation surface of the washing machine. In this case, a rotation axis coupled to the center of the rear part 12*c* in the rotation drum 12 is rotatably supported by the center part of the rear part of the water tub 11, so that the rotation drum 12 can be rotated in the water tub 11.

In this case, the reason why the above-mentioned rotation center line A has an inclination of a predetermined angle α on the basis of an installation surface of the washing machine is to gather a predetermined amount of water for washing/rinsing the laundry in the rotation drum 12, so that the laundry gets wet.

A large number of holes 12*d* are formed on a circumference of the rotation drum 12, a plurality of lifters to lift and lower the laundry during the rotation of the rotation drum 12, so that the rotation drum 12 can be rotated at a low speed during the washing process. As a result, the rotation drum 12 allows the wet laundry to be moved upward from the bottom of the rotation drum 12, and dropped on the bottom of the rotation drum 12, so that the laundry can be effectively washed.

The motor 15 is installed outside of the rear part 11*c* of the water tub 11. The motor 15 is used as a driver to rotate the rotation axis 13 connected to the rotation drum 12 to perform the washing, rinsing, and dehydration processes. The motor 15 includes a stator 15*a* fixed to the rear part 11*c* of the water tub 11, a rotor 15*b* rotatably installed at the outside of the stator 15*a*, and a rotation plate 15*c* to connect the rotor 15*b* to the rotation axis 13.

Therefore, the rotation axis 13 is alternately rotated forward and backward by the motor 15 during the washing or rinsing process, and allows the rotation drum 12 to be rotated at a low speed, so that the laundry is washed or rinsed. During the dehydration process, the rotation axis 13 rotates in only one direction to rotate the rotation drum at a high speed, so that the laundry is dehydrated.

A washing heater 16 to heat the water (specifically, water including a detergent) of the tub 11 is installed at a lower part inside of the tub 11.

The front part of the main body 10 includes an inlet 17*b* at a specific location corresponding to the inlet 12*b* and the inlet 11*b*, so that the user can put the laundry in the rotation drum 12 or take the laundry out of the rotation drum 12. A door 17 is installed to open or close the inlet 17*b*. A cylindrical diaphragm 11*d* is installed between the inlet 10*b* and the inlet 11*b* to prevent the water from leaking.

A detergent-supply unit 18 and a water-supply unit 20 are installed at an upper part of the water tub 11. A drain unit 19 including a drain pipe 19*a*, a drain valve 19*b*, and a drain pump 19*c* are installed at a lower part of the water tub 11, so that the water is drained out from the water tub 11.

The detergent-supply unit 18 is divided into several sections. The detergent-supply unit 18 is installed at the front part of the main body 10 so that the user can easily put the detergent or rinsing material in each section.

The divided sections include a preliminary-washing detergent box containing the detergent, and a fabric-softener box containing a fabric softener. A representative example associated with the above-mentioned conventional art has been disclosed in Korean Patent Application No. 2003-0011317, which is hereby incorporated by reference.

The water-supply unit 20 includes a first water-supply pipe 22 to connect an external water-supply pipe 21 (to supply water to the water tub 11) to a detergent-supply unit 18; a second water-supply pipe 23 to connect the detergent-supply unit 18 to the water tub 11; and a water-supply valve 24 installed at an intermediate part of the first water-supply pipe 22 to control a water-supply action. The above-mentioned configuration allows the water to be applied to the water tub via the detergent-supply unit 18, so that the detergent contained in the detergent-supply unit 18 can be applied to the water tub 11 along with the water.

Figure 2:
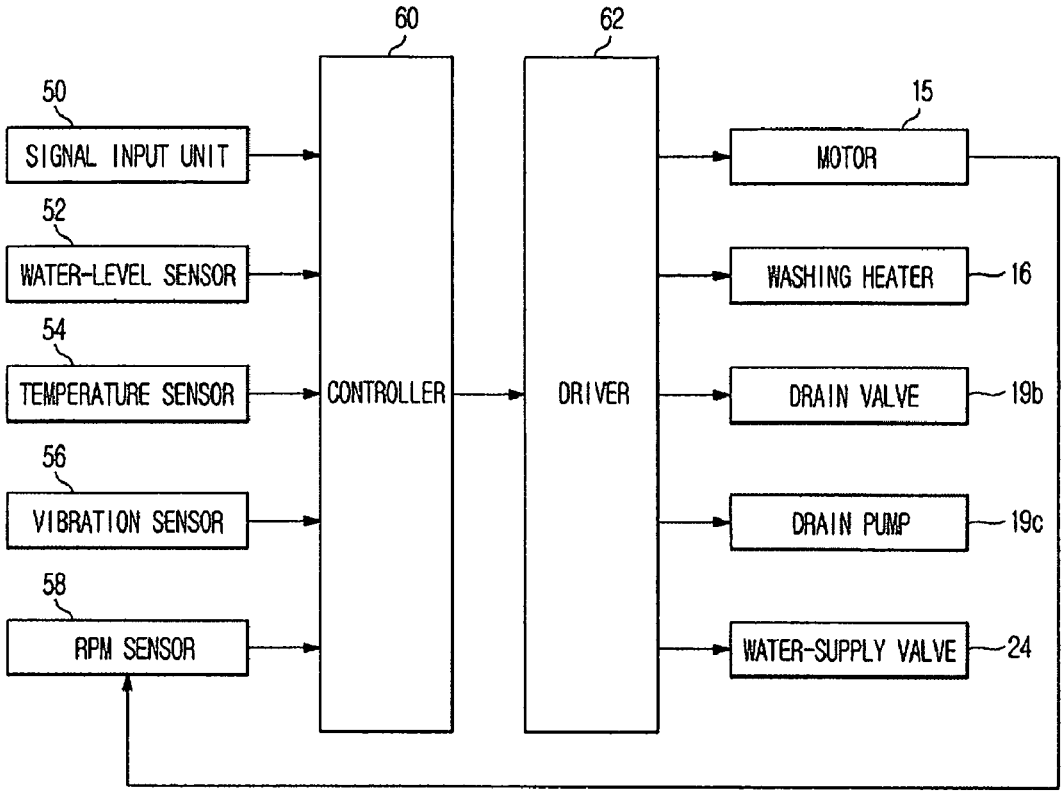
FIG. 2 is a block diagram illustrating a washing machine according to the embodiment of the present invention.

FIG. 2 is a block diagram illustrating a washing machine according to the embodiment of the present invention. In addition to the components of FIG. 1, the washing machine further includes a signal input unit 50, a water-level sensor 52, a temperature sensor 54, a vibration sensor 56, an rpm sensor 58, a controller 60, and a driver 62.

The signal input unit 50 enters a variety of operation information, for example, a user-selected washing course, a washing temperature, a dehydration rpm, and a rinsing addition, etc., in the controller 56, and detects a water level of water contained in the water level 11. The temperature sensor 54 detects a temperature of water supplied to the water tub 11.

The vibration sensor 56 detects the vibration of the water tub 11 to detect an unbalance caused by the laundry disentangling process, and detects the rpm of the motor to stepwise increase the laundry disentangling process.

The controller 60 is a microprocessor controlling the washing machine upon receiving operation information from the signal input unit 50, and stores a water-supply amount, a motor rpm, an operation rate (i.e., motor on/off time), and a total washing time, which are determined according to the laundry quantity (i.e., the laundry weight) in the selected washing course.

The controller 60 intermittently performs the laundry disentangling process to prevent the laundry from being tangled during the washing or rinsing process. For example, the laundry disentangling process may be performed before the drain process after the washing and rinsing processes, or may be performed after an intermediate dehydration of the washing or rinsing process. In the case of the laundry disentangling process, the controller 60 performs the laundry disentangling pattern, so that it stepwise increases the motor rpm, and at the same time adjusts the acceleration rate of the motor rpm at different acceleration rates during a predetermined time. Thus, the entangled laundry is evenly disentangled.

Figure 3:
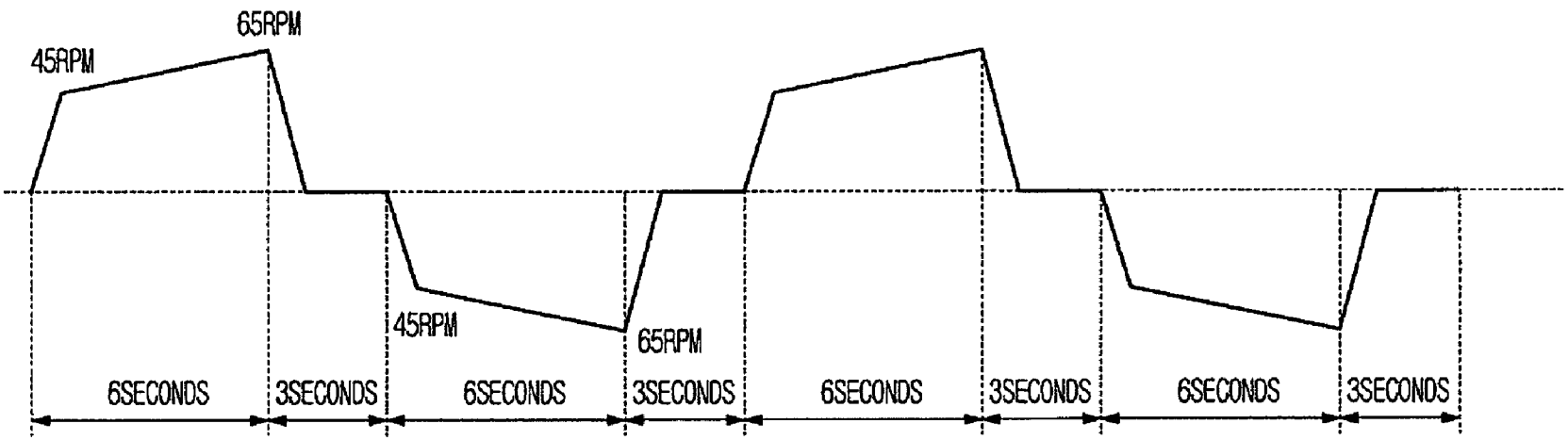
FIG. 3 is a motor control graph illustrating a laundry disentangling pattern of a washing machine according to the embodiment of the present invention.

The laundry disentangling pattern shown in FIG. 3 rotates the motor 15 in a forward direction for a first time (about 6 seconds), stops the motor 15 for a second time (about 3 seconds), rotates the motor 15 in a reverse direction for the first time, and stops the motor 15 for the second time. In this way, the laundry disentangling pattern alternately rotates the rotation drum 11, so that the laundry is shaken and disentangled.

The laundry disentangling pattern divides the motor rpm step into two steps (i.e., 45 rpm and 65 rpm) while the motor 15 rotates forward or backward for the first time. Until reaching the first rpm (45 rpm), the motor rpm increases at a first acceleration rate (e.g., 9.3 rpm/sec). In the range from the first rpm (45 rpm) to the second rpm (65 rpm), the motor rpm increases at a second acceleration rate (e.g., 5.4 rpm/sec), so that the laundry disentangling pattern disentangling the laundry can be changed in various ways.

The controller 60 detects vibration of the tub 11 caused by the unbalance using the vibration sensor 56 during the laundry disentangling process, so that it controls the laundry disentangling process to be executed within a predetermined time (i.e., a maximum time for the laundry disentangling process).

The driver 62 drives the motor 15, the washing heater 16, the drain valve 19*b*, the drain pump 19*c*, and the water-supply valve 24 upon receiving a driving control signal from the controller 60.

Operations and effects of the above-mentioned washing machine and the laundry disentangling control method will hereinafter be described.

If the user puts the laundry in the rotation drum 12 and selects desired operation information (i.e., a washing course, a washing temperature, a dehydration rpm, and a rinsing addition) according to the laundry type, the user-selected operation information is applied to the controller 60 via the signal input unit 50.

Therefore, the controller 60 conducts a series of processes to wash the laundry upon receiving the operation information from the signal input unit 50. In this case, the above-mentioned processes are a washing process to separate dirt or dust from the laundry using the water including a detergent, a rinsing process to rinse the laundry with clean water to remove bubbles or residual detergent from the laundry, and a dehydration process to dehydrate the laundry at a high speed. The laundry disentangling process to prevent the laundry from being entangled may be added to the washing and rinsing processes, as shown in FIG. 4.

Figure 4:
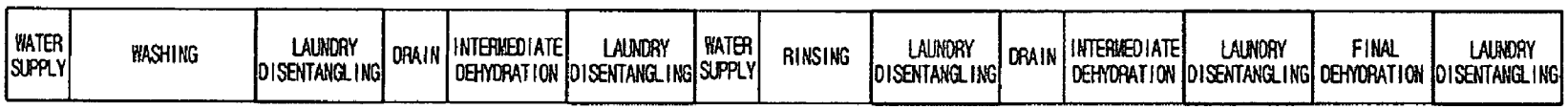
FIG. 4 is a table illustrating a predetermined period in which a laundry disentangling process is conducted from among a series of processes to wash the laundry according to the embodiment of the present invention.

FIG. 4 is a table illustrating a predetermined period in which a laundry disentangling process is conducted from among a series of processes to wash the laundry according to the embodiment of the present invention. The laundry disentangling process is occasionally conducted in the washing or rinsing process (e.g., before the drain process after the washing/rinsing processes, or after the intermediate dehydration of the washing/rinsing process), and may also be conducted after the final dehydration process.

The laundry disentangling process in the rinsing process may be continuously performed a predetermined number of rinsing times, or may also be performed in the final rinsing process only. In order to implement an optimum algorithm to improve the performance of the washing machine, the laundry disentangling process may be added or modified.

The embodiment of the present invention is characterized in the laundry disentangling process, so that the following description will mainly disclose the operations and effects of the present invention on the basis of the laundry disentangling process.

Figure 5A:
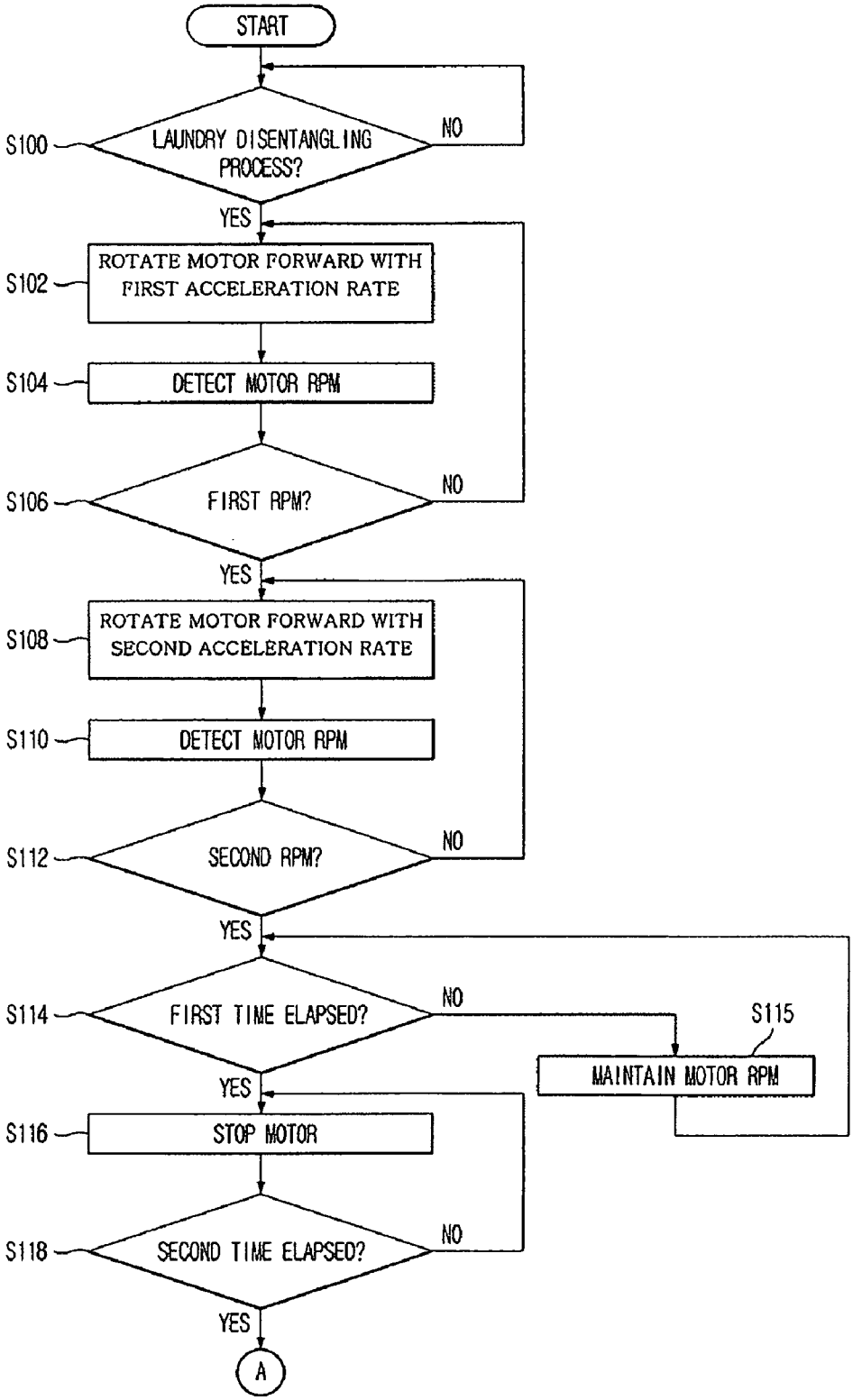
FIGS. 5A and 5B are flow charts illustrating a method of controlling a laundry disentangling process of the washing machine according to the embodiment of the present invention.
Figure 5B:
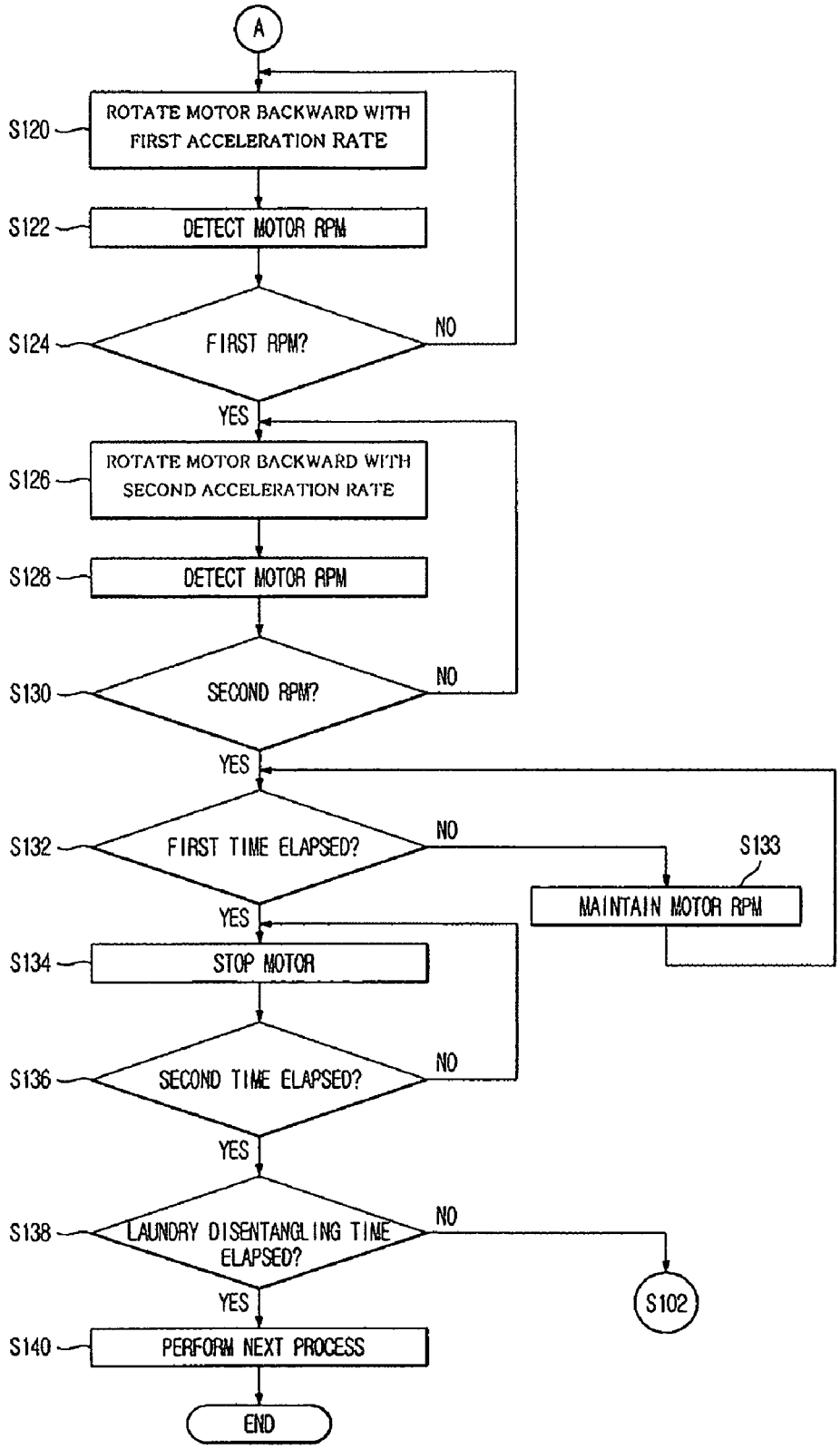

FIGS. 5A and 5B are flow charts illustrating a method of controlling a laundry disentangling process of the washing machine according to the embodiment of the present invention.

Referring to FIGS. 5A and 5B, the controller 60 determines whether a laundry disentangling process is occasionally performed in the washing or rinsing process at operation S100. In the case of the laundry disentangling process, the controller 60 rotates the motor 15 in a forward direction at a first acceleration rate (e.g., 9.3 rpm/sec) at operation S102.

If the motor 15 rotates forward at the first acceleration rate, the rotation drum 12 also rotates forward, so that the rotation speed of the motor quickly increases. In this case, the rpm sensor 58 detects the rising rpm of the motor 15, and transmits the detected rpm to the controller 60 at operation S104.

Therefore, the controller 60 compares speed of the motor 15 detected by the rpm sensor 58 with a predetermined first rpm (45 rpm), and determines whether the detected rpm reaches a first rpm at operation S106.

If the rpm does not reach the first rpm at operation S106, the controller 60 quickly rotates forward at the first acceleration rate until the rpm of the motor 15 reaches the first rpm. If the speed reaches the first rpm, the controller 60 continuously rotates the motor 15 in the forward direction at a second acceleration rate (e.g., 5.3 rpm/sec) to reduce the acceleration rate of the motor 15 at operation S108.

If the rotation drum 12 continuously rotates forward as the motor 15 rotates forward at the second acceleration rate, the rotation speed begins to slowly increase. In this case, the rpm sensor 58 detects the rising rotation speed of the motor 15, and enters the detected rising rotation speed in the controller 60 at operation S110.

Therefore, the controller 60 compares the rpm detected by the rpm sensor 58 with a predetermined second rpm (65 rpm), and determines whether the detected rpm reaches the second rpm at operation S112.

If the detected rpm does not reach the second rpm at operation S112, the controller 60 slowly rotates the motor in a forward direction until the motor rpm reaches the second rpm. If the motor rpm reaches the second rpm, the controller 60 counts the amount of the forward rotation time of the motor 15, and determines whether a first time (i.e., a time for the motor's forward rotation according to the laundry disentangling pattern of FIG. 3) elapses at operation S114.

If the first time does not elapse at operation S114, the controller 60 maintains the motor rpm and waits for the counted time to reach the first time or more at operation S115. If the first time elapses, the motor 15 stops rotation at operation S116.

If the motor 15 stops operation, the motor rpm is gradually lowered by inertial force. In this case, the controller 60 counts the stop operation of the motor 15, and determines whether a predetermined second time (i.e., a time for stopping the motor according to the laundry disentangling pattern of FIG. 3) elapses or not at operation S118.

If the second time does not elapse at operation S118, the controller 60 maintains the motor 15 in a stopped state. Then, if the second time elapses, the controller 60 rotates the motor in a reverse direction at a first acceleration rate (e.g., 9.3 rpm/sec) to re-drive the motor 15 at operation S120.

If the motor 15 rotates in the reverse direction at the first acceleration, the rotation drum 12 also rotates in the reverse direction, the motor rpm begins to quickly increase. In this case, the rpm sensor 58 detects the motor rpm, and enters the detected motor rpm in the controller 60 at operation S122.

Therefore, the controller 60 compares the motor rpm detected by the rpm sensor 58 with the first rpm (45 rpm), and determines whether the motor rpm reaches the first rpm at operation S124.

If the motor rpm does not reach the first rpm at operation S122, the controller 60 quickly rotates backward at the first acceleration rate until the speed of the motor 15 reaches the first rpm. If the speed reaches the first rpm, the controller 60 continuously rotates the motor 15 in the forward direction at a second acceleration rate (e.g., 5.3 rpm/sec) to reduce the acceleration rate of the motor 15 at operation S126.

If the rotation drum 12 continuously rotates backward as the motor 15 rotates backward at the second acceleration rate, the motor 15's rotation speed begins to slowly increase. In this case, the rpm sensor 58 detects the rising rotation speed of the motor 15, and enters the detected rising rotation speed in the controller 60 at operation S128.

Therefore, the controller 60 compares the motor 15's rpm detected by the rpm sensor 58 with a predetermined second rpm (65 rpm), and determines whether the motor 15's rpm reaches the second rpm at operation S130.

If the motor 15's rpm does not reach the second rpm at operation S130, the controller 60 slowly rotates the motor in a reverse direction until the motor rpm reaches the second rpm. If the motor rpm reaches the second rpm, the controller 60 counts the amount of the reverse rotation time of the motor 15, and determines whether a first time (i.e., a time for the motor's reverse rotation according to the laundry disentangling pattern of FIG. 3) elapses at operation S132.

If the first time does not elapse at operation S132, the controller 60 maintains the motor rpm and waits for the counted time to reach the first time or more at operation S133. If the first time elapses, the motor 15 stops rotation at operation S134.

If the motor 15 stops operation, the motor rpm is gradually lowered by inertial force. In this case, the controller 60 counts the stop operation of the motor 15, and determines whether the second time elapses or not at operation S136.

If the second time does not elapse at operation S136, the controller 60 maintains the halted motor 15. Then, if the second time elapses, the controller 60 counts the processing time of the laundry disentangling process, and decides whether the counted laundry disentangle time is longer than a predetermined laundry disentangling time (i.e., an optimum laundry disentangling time (about 1.6 minute) for preventing the tangled laundry) at operation S138.

The above-mentioned laundry disentangling time is set for the laundry disentangling process, so that the laundry disentangling process is conducted within a predetermined time after detecting the water tub 11 vibration caused by the unbalance by the vibration sensor 56. It can be easily recognized that the laundry disentangling time of the embodiment of the present invention is much shorter than the conventional laundry disentangling time (about 4.9 minutes).

If the laundry disentangling time does not elapse at operation S138, the controller 60 returns to operation S102 to continuously perform the laundry disentangling process. The controller 60 rotates the motor 15 forward during the first time, stops the motor 15 during the second time, rotates the motor 15 backward during the first time, and stops the motor 15 during the second time. In this way, the controller 60 alternately operates the motor in the above-mentioned order a predetermined number of times.

If the laundry disentangling time elapses at operation S138, the controller 60 performs the next process, and terminates the operation S140.

Although the present invention has disclosed the drum-type washing machine dedicated to the washing function, it should be noted that the scope of the present invention is not limited to the above-mentioned drum washing machine, and may also be applied to other drum washing machines, each of which includes a dryer.

As is apparent from the above description, the washing machine according to the embodiment of the present invention evenly disentangles tangled laundry using a laundry disentangling pattern, which is capable of stepwise-increasing a motor rpm simultaneously while adjusting a motor acceleration rate, so that a performance of the washing machine is improved. And, the washing machine can easily control the water-supply control operation, and can prevent the dehydration time from being delayed by an unbalance.

The embodiment of the present invention enables the user to easily take out the laundry from the washing machine after the final dehydration. If the washing machine has a dehydration function conducted by a dehydration process, the embodiment of the present invention allows the laundry to easily move in the washing machine, so that a drying time is reduced, resulting in improvement of the washing machine performance.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A method of controlling a laundry disentangling process in a washing machine, which includes a rotation drum containing laundry and a motor rotating the rotation drum to disentangle tangled laundry, the method comprising:

(a) rotating the motor to one direction between a forward direction and a reverse direction;

(b) detecting an rpm of the motor while rotating the motor at a first acceleration rate if the motor starts rotating in the one direction;

(c) determining whether the rpm of the motor reaches a first rpm, which is set in advance, by comparing the detected rpm of the motor with the first rpm;

(d) detecting an rpm of the motor while rotating the motor at a second acceleration rate lower than the first acceleration rate if determined that the rpm of the motor reaches the first rpm, (e) determining whether the rpm of the motor reaches a second rpm, which is set in advance, by comparing the detected rpm of the motor with the second rpm;

(f) determining whether a first time, which is set in advance, elapses by counting the amount of time for the motor being rotated in the one direction if determined that the rpm of the motor reaches the second rpm;

(g) stopping the rotation of the motor during a second time shorter than the first time if determined that the first time elapses; and (h) rotating the motor to an opposite direction after rotating the motor in the forward or reverse direction, wherein an operation including from (b) to (g) is performed to disentangle the laundry inside the rotation drum if the motor starts rotating to the opposite direction.

2. The method according to claim 1, wherein the laundry disentangling process is performed in a washing or rinsing process of the washing machine.

3. The method according to claim 2, wherein the laundry disentangling process is performed before a drain process after the washing process, or is performed after an intermediate dehydration after the washing process.

4. The method according to claim 2, wherein the laundry disentangling process is performed before a drain process after the rinsing process, or is performed after an intermediate dehydration after the rinsing process.

5. The method according to claim 1, wherein the laundry disentangling process is performed after the last dehydration process of the washing machine.

6. The method according to claim 1, wherein the first acceleration rate is approximately 9.3 rpm/sec, and the second acceleration rate is approximately 5.4 rpm/sec.

7. The method according to claim 1, wherein the first rpm is at least 40 rpm.

8. The method according to claim 7, wherein the first rpm is 40-65 rpm.

9. The method according to claim 8, wherein the second rpm is equal to or higher than the first rpm.

10. The method according to claim 1, wherein the second acceleration rate is equal to or less than the first acceleration rate.

* * * * *